US005487697A

United States Patent [19]

Jensen

[11] Patent Number: 5,487,697

[45] Date of Patent: Jan. 30, 1996

[54] POLISHING APPARATUS AND METHOD USING A ROTARY WORK HOLDER TRAVELLING DOWN A RAIL FOR POLISHING A WORKPIECE WITH LINEAR PADS

[75] Inventor: Elmer W. Jensen, New Castle, Del.

[73] Assignee: Rodel, Inc., Newark, Del.

[21] Appl. No.: 15,609

[22] Filed: Feb. 9, 1993

[51] Int. Cl.[6] ..... B24B 7/00

[52] U.S. Cl. ..... 451/324; 451/41; 451/320; 451/314; 451/317; 451/394; 451/398; 451/143; 451/246

[58] Field of Search ..... 51/150, 151, 154, 51/156, 157, 161, 211 R, 232, 235, 236, 237 R, 263, 317, 283 R; 451/140, 143, 313, 314, 317, 319, 320, 324, 552, 394, 388, 397, 398, 446, 41, 36, 242, 246

[56] References Cited

U.S. PATENT DOCUMENTS

| | | | |
|---|---|---|---|
| 4,141,180 | 2/1979 | Gill, Jr. et al. | 51/5 R |
| 4,193,226 | 3/1980 | Gill, Jr. et al. | 51/124 R |
| 4,663,890 | 5/1987 | Brandt | 51/283 R |
| 4,680,893 | 4/1987 | Cronkhite et al. | 51/5 R |
| 4,918,870 | 4/1990 | Torbert et al. | 51/131.1 |
| 4,934,102 | 6/1990 | Leach et al. | 51/50 R |
| 5,113,622 | 5/1982 | Nishiguchi et al. | 51/165.73 |
| 5,123,214 | 6/1992 | Ishimura et al. | 51/165.77 |
| 5,230,184 | 7/1993 | Bukhman | 51/283 R |

*Primary Examiner*—Bruce M. Kisliuk
*Assistant Examiner*—Eileen P. Morgan
*Attorney, Agent, or Firm*—Kenneth A. Benson

[57] ABSTRACT

The present invention relates to an apparatus for polishing semiconductor wafers and, in particular, one in which the polishing pads are linear, that is, the polishing pads have a long linear dimension relative to their width and have a uniform cross-section along this linear dimension. In addition, the wafer holder travels in a straight line parallel to the long linear dimension of the polishing pads.

20 Claims, 4 Drawing Sheets

POLISHING APPARATUS AND METHOD USING A ROTARY WORK HOLDER TRAVELLING DOWN A RAIL FOR POLISHING A WORKPIECE WITH LINEAR PADS

BACKGROUND OF THE INVENTION

Field of the Invention

The present invention relates to an apparatus for polishing semiconductor wafers and, in particular, one in which the polishing pads are linear, that is, the polishing pads have a long linear dimension relative to their width and have a uniform cross-section along this linear dimension. In addition, the wafer holder travels in a straight line parallel to the long linear dimension of the polishing pads.

Description of the Prior Art

Currently, silicon wafers for semiconductor use are polished with machines which use circular polishing pads that are sometimes rotated. Examples of such machines are disclosed in U.S. Pat. Nos. 4,141,180, 4,193,226, 4,680,893, 4,918,870 and 5,123,214. These machines all provide circular polishing pads to which polishing slurry is added as the silicon wafers are pressed against and passed over the pad surface. The wafers are held in carriers which hold one or more wafers. The carriers may rotate the wafers about a central carrier axis which is parallel to the axis of rotation of the table and polishing pad and may even provide an oscillatory motion to the wafers as they pass over the polishing pad. One disadvantage of this type of polishing machine is that the pieces to be is polished repeatedly traverse the same path or series of tracks. As a result the polishing pad surface wears unevenly resulting in a non-level, concave pad surface. This dishing of the pad produces a convex work piece which is unacceptable. A semiconductor wafer has to be ultra-flat, have a precise thickness and have precise parallel surfaces. Another disadvantage of rotary polishing pads is that the speed of the pad relative to the wafer to be polished varies from the center to the circumference of the pad. Thus the surface contact rate and the polishing rate varies from the center to the periphery of the pad. U.S. Pat. No. 5,020,283 shows a means to make the polishing rate more uniformly providing a circular polishing pad with voids which are more numerous at the periphery of the pad. This is a very complex way to try to make the polishing rate more uniform over the surface of the pad. A further disadvantage is that polishing slurry will not spread in an even manner over a circular pad surface no matter where on the surface it is introduced. Thus, polishing action will vary from place to place on the pad surface not only due to the variation in the speed of the pad relative to the wafer, but also due to the uneven distribution of slurry on the pad. Such differences in polishing action are minimized by the use of linear pads and the straight-line traverse of the wafer carrier. Other disadvantages are apparent when the entire surface of a wafer to be polished is simultaneously in contact with the polishing pad. Polishing slurry trapped between the wafer and the polishing pad causes the wafer to skate, sometimes unevenly, over the surface of the pad as it pushes slurry out from between the wafer and the pad. This skating action can cause uneven wear on the wafer even when it may be rotating relative to the pad. Temperature uniformity is also difficult to control over a pad with a large surface area. Elaborate methods to control temperature uniformity are sometimes used, such as the technique shown in U.S. Pat. No. 5,113,622.

SUMMARY OF THE INVENTION.

It is the object of the present invention to provide a machine for polishing semiconductor wafers which is flexible in operation and will perform the polishing of semiconductor wafers with greater efficiency and preciseness than heretofore possible. It is a further object of the invention to provide polishing pads and equipment for polishing semiconductor wafers which is more cost effective.

In order to achieve these objectives polishing equipment is provided comprising linear polishing pads used with a workpiece carrier which travels in a straight line parallel to the long linear dimension of the polishing pads. A linear polishing pad is defined as a polishing pad having a surface which contacts the wafer to be polished said surface being long and narrow like a ribbon. The length of the surface is at least ten times the width of the surface which contacts the wafer. By passing the wafer to be polished over a relatively narrow polishing pad one is accomplishing the leveling of the semiconductor wafer by a surface which approaches a line. Indeed, if the polishing pad has a curved surface opposing the surface of the wafer to be polished, the leveling action is that of a line across the surface of the wafer. This inherently gives a precise leveling of the surface. Also, if the workpiece carrier is moving parallel to the pad, a different surface of the pad is exposed for each sweep of a wafer over each polishing pad. Thus there is no chance for the pad surface to dish or wear unevenly due to continual passage of wafers over the same pad surface. If the linear polishing pads have a circular cross-section and are rotated as well, they will provide a fresh surface for contact with the wafers at all times. The axis of rotation of such polishing pads is, of course, orthogonal to the axis of rotation of the wafer carrier. Such linear polishing pads make it easy to add slurry to the polishing operation and have the slurry perform its chemical and physical role in the polishing operation quickly. In so doing, reactive monomers and other detrimental elements formed in the active slurry are easily flushed away before further reaction with the surface of the semiconductor wafer occurs. Also it is readily seen that the temperature of linear polishing pads is easy to control by passing a liquid temperature control medium through them or by any other temperature control system used in the art. The uniform cross-section of the pads and the uniform action of the semiconductor wafer in relation to the pad make it easy to maintain a constant temperature profile where the polishing action is being accomplished. The accomplishment of these objectives and advantages will become apparent from the following description of the drawings and the discussion of the preferred embodiments of the invention.

DETAILED DESCRIPTION OF THE PREFERRED EMBODIMENTS

Figure 1:
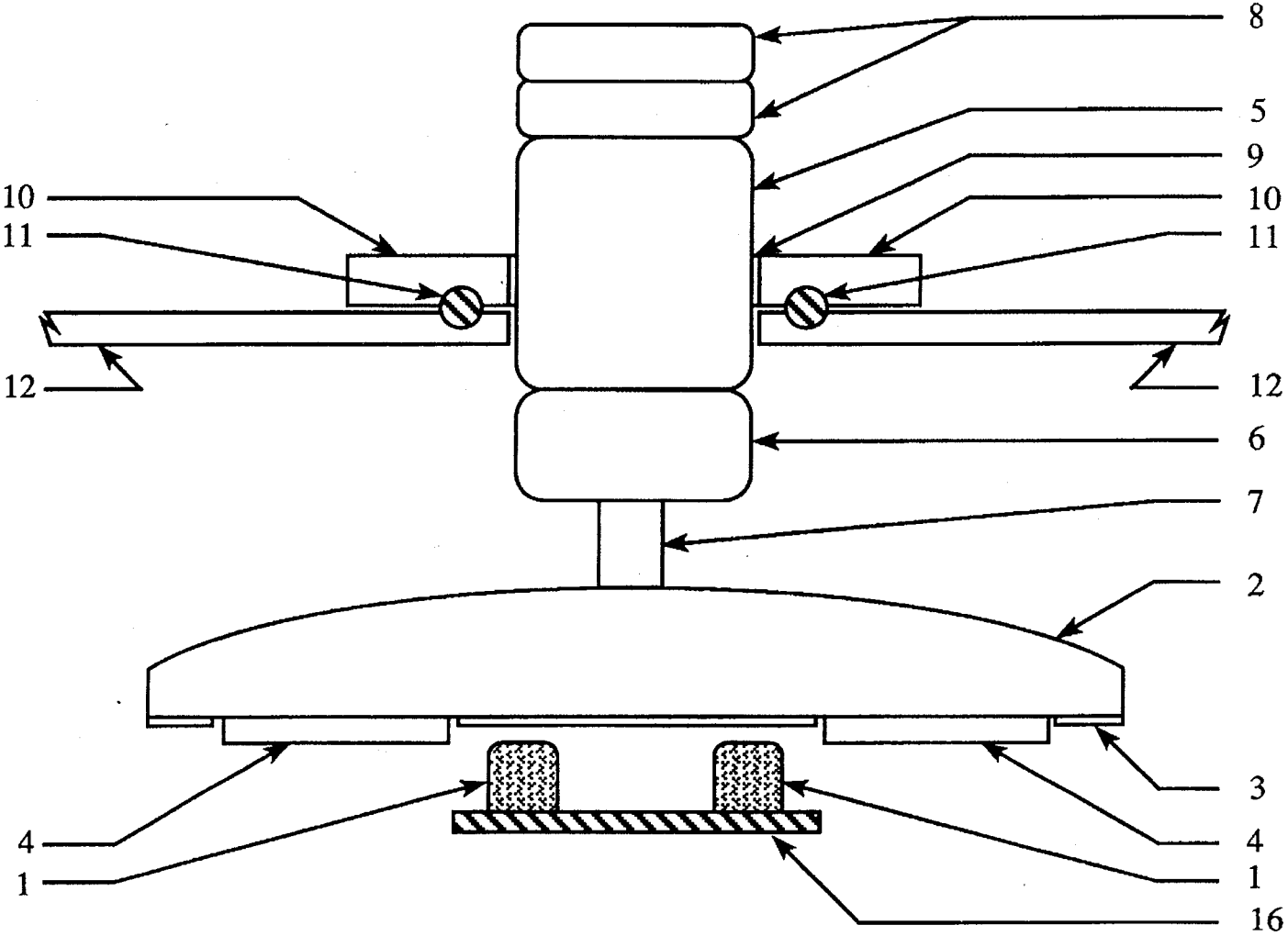
FIG. 1 shows a polishing apparatus with a single carrier designed to polish one surface of the wafers being held in the carrier and which traverses linear polishing pads.

FIG. 1 shows the cross-section of a common type of holder or head 2 on which semiconductor wafers 4 to be polished are held by vacuum or some other form of adhesion to indentations on the under surface 3 of the holder or head 2. The holder 2 can be rotated by spindle 7 which is actuated by gearbox 6 and motor 5. The motor 5 is held in a fixed horizontal position by collar 9 attached to motor mounts 10. The motor mounts 10 rest on stabilizer rails 11 which are held in a horizontal position by stabilizer support members 12. These support members may be actuated in such a way that the entire wafer holder assembly will press against the polishing pads with a force determined by the loading on the support members 12 and by the removeable dead weights 8 positioned on the motor 5. The loading on the support members and the wafer holder assembly may be accomplished by springs, weights, hydraulic mechanisms, magnetic induction or any other suitable means for applying a steady force. The polishing pads which as shown could also be called finishing rails 1 are shown supported by table 16. The pads may be supported in other ways, for example, they may be supported at their ends in such a way that they may be rotated or otherwise moved in some way as the workpieces 4 travel down their length. The workpiece holder 2 may rotate or oscillate as the entire assembly moves slowly along the stabilizer rails 11. By such motion each wafer or work piece 4 does not traverse the linear polishing pad or finishing rail 1 on the same pattern more than once and each portion of the upper surface of the finishing rail 11 receives equal wear. The holder 2 may hold as many work pieces 4 as desired. Individual work pieces 4 may be made to rotate, oscillate, revolve or vibrate as long as the flat surfaces of the workpieces which are being polished remain in the plane where the polishing is carried out. In this same plane are the pad surfaces on which the polishing is carried out. In the case of flat topped linear polishing pads as shown in FIG. 1, the top surface of the linear polishing pads 1 and the bottom surface of the workpieces 4 being polished define the plane of polishing. The polishing pad may also be made to rotate, oscillate, revolve or vibrate as long as the working surface of the pad remains in the plane of polishing. If curved or cylindrical polishing pads as shown in FIGS. 4, 6, 7, 8 and 9 were to be used, the polishing surfaces of these pads are tangential to the plane of polishing. The work pieces do not have to be wafers. They can be of any size, shape and of any material. The drive mechanism for moving the assembly down the stabilizer rails 11 is not shown. It may be any suitable drive such as a gear, screw or belt drive and may have variably adjustable speed.

Figure 2:
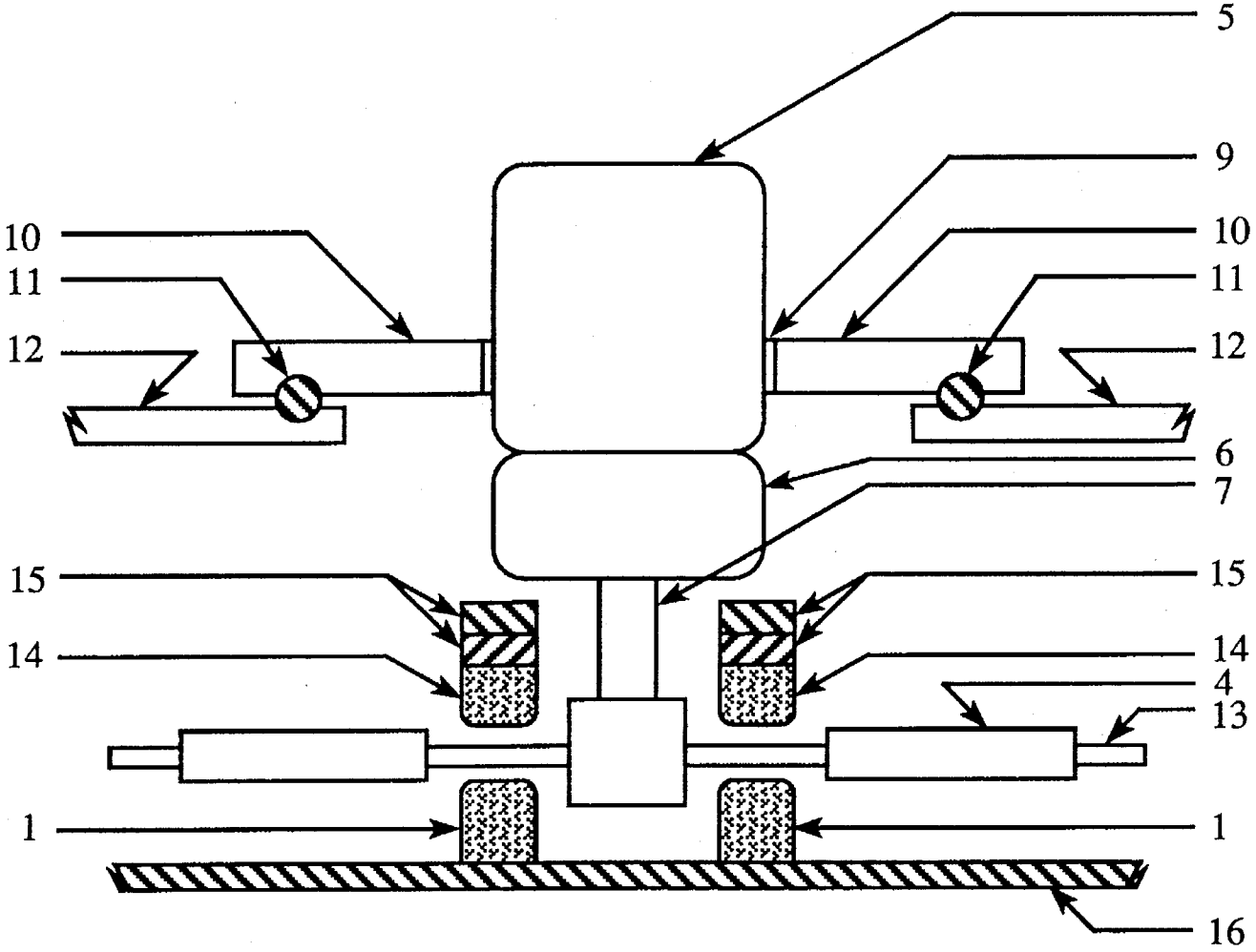
FIG. 2 shows a polishing apparatus with a single carrier designed to polish both surfaces of the wafers being held in the carrier and which traverses linear polishing pads positioned on both side of the wafer carrier.

FIG. 2 shows the cross-section of a similar machine in which wafers 4 are held in a holder 13 in such a way that both sides of each wafer may be polished at the same time. In this case there are top finishing rails (linear polishing pads) 14 as well as bottom finishing rails (linear polishing pads) 1. The top finishing rails 14 may be weighted with removeable dead weights 15 which can be adjusted to give the desired polishing action. Again, the holder 13 can be rotated, oscillated or vibrated as it moves slowly down the stabilizer rails 11.

Figure 3:
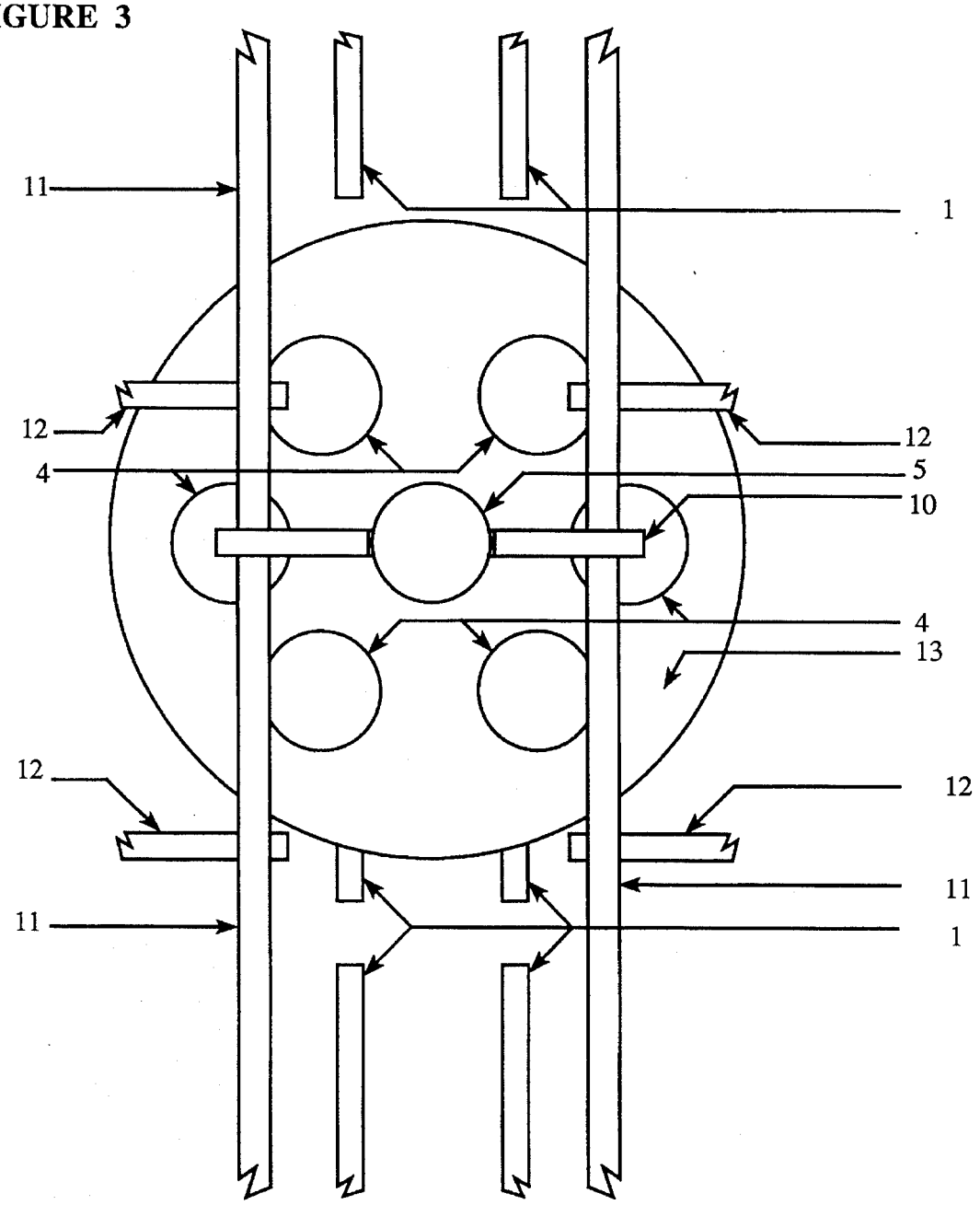
FIG. 3 shows a top view of the apparatus shown in FIG. 2 without the upper polishing pads and weights in place.

FIG. 3, a top plan view of the carrier 13 and bottom linear polishing pads 1 shown in FIG. 2, shows how the linear polishing pads 1 are divided into sections so that the type of pad, the shape of pad and the action of the pad may be easily changed as the carrier assembly moves linearly down the machine. One can readily see that more than one carrier can be travelling down the machine at the same time and that portions of the machine can be set up for any desireable activity such as abrasion of the workpiece, cleaning the surface of the workpiece as well as polishing the workpiece. Slurry for polishing may be introduced to the linear polishing pad surface at any desired points.

Figure 4:
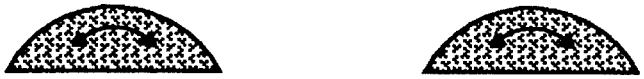
FIGS. 4, 5, 6, 7, 8 and 9 show several alternate forms for the shape of the polishing pads shown in FIGS. 1, 2 and 3.
Figure 5:
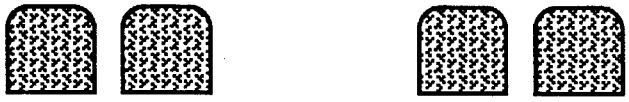
Figure 6:
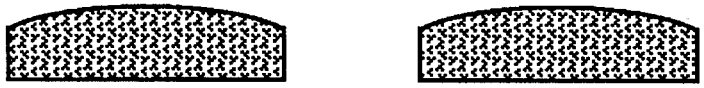
Figure 7:
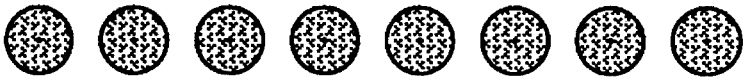
Figure 8:
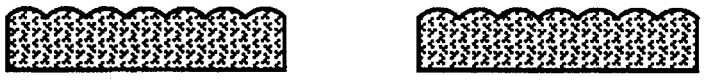
Figure 9:
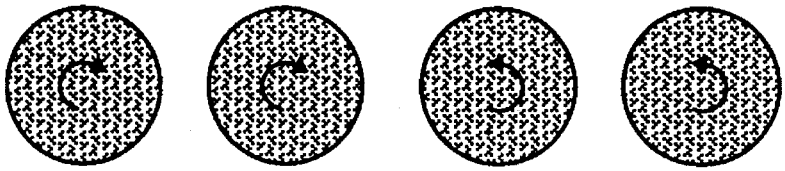

The linear polishing pads shown in FIGS. 1, 2 and 3 can be made in any number of cross-sectional shapes. FIG. 4 shows a hemispherical cross section. In this case the tangential meeting of the workpiece surface and the linear polishing pad provides a narrow linear working surface which should maximize workpiece flatness. These linear polishing pads may be rotated or oscillated to expose a different surface to the workpiece at different times. In FIG. 5 the linear pads are shown split into pairs. They may, of course, be split into any number of linear units. In FIG. 6 the curved surface working surface is much shallower than the working surface shown for the FIG. 4 hemispherical pads. The pads could even be cylindrical, as shown in FIG. 7 and FIG. 9. In cylindrical form they could be made to rotate continuously or intermittently in either direction. As shown in FIG. 9 the pads on each side of the machine could rotate in opposite directions. Again, the polishing pad surface can be curved or flat and may even have a textured surface as shown on the ones in FIG. 8.

It is obvious from the preceeding discussions that the entire polishing machine need not be linear. Movement of the carrier from section to section of the machine may be through an angle or an arc without detrimental effect on the performance of the linear pads.

The preceding embodiments show the great versatility of a linear polishing machine. The linear polishing pads may have a narrow line contact with the workpiece or may have a broader contact with the workpiece if the upper surface of the polishing pad is flat and relatively wide. Also, with the movement of the workpiece along a series of straight-line paths, time and space is provided for different operations to be performed on the workpiece. As well as variable degrees of polishing, these may be cleaning, inspecting, measuring or even encasing the polishing operation in a chamber holding an inert atmosphere. The foregoing preferred embodiments are considered illustrative only. Other modifications will readily occur to those persons skilled in the pertinent art. Consequently, the disclosed invention is not limited to the exact construction shown and described but is defined by the claims appended hereto.

What is claimed is:

1. An apparatus for polishing a flat surface comprising: (a) one or more linear polishing pads each of which has a long linear dimension such that the surface of each pad which contacts said workpiece is long and narrow; and (b) a carrier which holds at least one workpiece to be polished, said carrier mounted to a rail which is parallel to a longitudinal axis of said linear polishing pad or pads whereby said carrier periodically passes each workpiece over a different portion of said pad surface as said carrier travels along said rail generally in a straight line parallel to said long linear dimension of said linear polishing pad or pads down the length of said linear polishing pad or pads.

2. An apparatus according to claim 1, wherein said workpiece is a semiconductor wafer.

3. An apparatus according to claim 1, wherein said carrier rotates about an axis perpendicular to said straight line of travel of said carrier.

4. An apparatus according to claim 3, wherein said workpiece is a semiconductor wafer.

5. An apparatus according to claim 1, further comprising: (c) means for holding said workpiece against said linear polishing pads with a steady pressure.

6. An apparatus according to claim 5, wherein said workpiece is a semiconductor wafer.

7. An apparatus according to claim 5, wherein the pressure holding said workpiece against said linear polishing pads is adjustable.

8. An apparatus according to claim 7, wherein said workpiece is a semiconductor wafer.

9. An apparatus according to claim 1, wherein the cross-section of said linear polishing pad is rectangular.

10. An apparatus according to claim 9, wherein said workpiece is a semiconductor wafer.

11. An apparatus according to claim 1, wherein the surface of said linear polishing pad which contacts said workpiece is part of a cylindrical surface.

12. An apparatus according to claim 11, wherein said workpiece is a semiconductor wafer.

13. An apparatus according to claim 11, wherein said linear polishing pad is moved about its axis to continuously expose fresh pad surface to said workpiece.

14. An apparatus according to claim 13, wherein said workpiece is a semiconductor wafer.

15. An apparatus according to claim 1 , wherein polishing composition is applied to said linear polishing pads.

16. An apparatus according to claim 15, wherein said workpiece is a semiconductor wafer.

17. An apparatus according to claim 15, wherein said polishing composition is a slurry.

18. An apparatus according to claim 17, wherein said workpiece is a semiconductor wafer.

19. A method for polishing a flat surface of a workpiece comprising: (a) placing said workpiece in a carrier mounted to a rail which is parallel to a longitudinal axis of linear polishing pad or pads and (b) periodically passing said workpiece over a different portion of the surface of said polishing pad or pads as said carrier travels along said rail generally in a straight line parallel to a long linear dimension of said polishing pad or pads down the length of said linear polishing pad or pads.

20. A method according to claim 19, wherein said workpiece is a semiconductor wafer.

* * * * *